US005638797A

United States Patent [19]

Kim

[11] Patent Number: 5,638,797

[45] Date of Patent: Jun. 17, 1997

[54] TURBULENCE GENERATING APPARATUS IN THE INTAKE MANIFOLD

[75] Inventor: Yun-Tac Kim, Kyunggi-do, Rep. of Korea

[73] Assignee: Hyundai Motor Company, Seoul, Rep. of Korea

[21] Appl. No.: 689,120

[22] Filed: Jul. 30, 1996

[30] Foreign Application Priority Data

Jul. 31, 1995 [KR] Rep. of Korea ..... 95-23206

[51] Int. Cl.[6] ..... F02M 29/02

[52] U.S. Cl. ..... 123/592; 261/84

[58] Field of Search ..... 123/590–593; 261/84, 79.1

[56] References Cited

U.S. PATENT DOCUMENTS

| | | | |
|---|---|---|---|
| 1,123,876 | 1/1915 | Hiddleson | 123/592 |
| 4,537,173 | 8/1985 | Norris | 123/592 |
| 4,966,123 | 10/1990 | Hofmeester | 123/592 |
| 5,137,005 | 8/1992 | Kirby | 123/592 |

*Primary Examiner*—Erick R. Solis
*Attorney, Agent, or Firm*—Finnegan, Henderson, Farabow, Garrett & Dunner, L.L.P.

[57] ABSTRACT

An apparatus for generating turbulence in the intake manifold of an engine in a motor vehicle, the apparatus comprising a reversable step motor having a drive shaft and a drive gear fixed thereto; an elongated shaft being disposed for slidable movement along its axis and having one end disposed in the intake manifold and the other end extending outside the intake manifold, the other end of the shaft including a rack gear drivingly engaged by the drive gear; an anchor fixed in the intake manifold and supporting the shaft for axial movement; a plurality of fan blades mounted at the one end of the shaft for rotation about the shaft axis, each blade being pivotally mounted for movement between folded and unfolded positions in response to axial movement of the shaft; and a control unit for electrically operating the step motor in response to engine rotation rate or vehicle speed to cause the blades to unfold into the intake air stream when the rate or speed is below a predetermined value and to fold when the rate or speed is above a predetermined value.

2 Claims, 2 Drawing Sheets

TURBULENCE GENERATING APPARATUS IN THE INTAKE MANIFOLD

BACKGROUND OF THE INVENTION

1. Field of the Invention

The present invention relates to a turbulence generating apparatus disposed in the intake manifold of a vehicle engine. The apparatus generates turbulence in the air flow of the intake at low speed operation to promote atomization of fuel but reduces streaming resistance against the air flow at high speed operation.

2. Description of Prior Art

Air is inhaled via an intake manifold through an air filter into an automobile engine. The inflow rate of air varies in accordance with the engine speed. The inhaled air is mixed in appropriate ratio with fuel injected from the inhalation port and subsequently driven into the cylinder. In the cylinder, the mixture of fuel and air ignites, causing reciprocal motion of the piston in the cylinder resulting in power.

The ratio of fuel air mixture introduced into the cylinder is the most important factor for the improvement of engine power. Variable engine speed creates a difference in the inflow rate of air to be mixed with fuel. At high speed operation, the suction power in the cylinder is strong because the explosive power is high, so the air is inhaled rapidly and mixes well with fuel. On the other hand, at low speed operation, the suction power in the cylinder decreases so the air is introduced very slowly and mixes poorly with fuel, thereby reducing combustion efficiency. Engine power, therefore drops.

The low speed air resulting from weak inhalation mixes poorly with the injected fuel, so fuel cannot be carbureted fully and is driven into the cylinder at the drop state causing imperfect combustion and generation of large amounts of harmful exhaust gas. For this reason, a subsidiary turbulence device often is installed near the air cleaner, but is difficult to maintain the turbulent flow generated by this device. If this device is installed near the combustion cylinder, it becomes an obstacle to disturb the air flow at high speed operation, so it degrades the performance of the engine.

SUMMARY OF THE PRESENT INVENTION

The objects and advantages of the invention may be realize and attained by means of the instrumentalities and combinations particularly pointed out in the appended claims.

In accordance with the invention, the apparatus for generating turbulence in the intake manifold of an engine of a motor vehicle comprises a reversible step motor having a drive shaft and a drive gear fixed thereto, an elongated shaft being disposed for slidable movement along its axis and having one end disposed in the intake manifold and the other end extending outside the intake manifold, the other end of the shaft including a rack gear drivingly engaged by the drive gear, an anchor fixed to the intake manifold and supporting the shaft for axial movement, a plurality of fan blades mounted at one end of the shaft for rotation about the shaft axis, each blade being pivotally mounted for movement between folded and unfolded positions in response to axial movement of the shaft, and a control unit for electrically operating the step motor in response to engine rotation rate or vehicle speed to cause the blades to unfold into the intake air stream when the rate or speed is below a predetermined value and to fold when the rate or speed is above a predetermined value.

Preferably, the anchor includes a bearing structure slidably supporting the shaft and rotatable with respect to the shaft, each blade being connected to the bearing structure for pivotal movement between folded and unfolded positions in response to axially movement of the shaft.

BRIEF DESCRIPTION OF THE DRAWINGS

The accompanying drawings, which are incorporated in and constitute a part of the specification, illustrate embodiments of the invention, and, together with the description, serve to explain the principles of the invention.

DETAILED DESCRIPTION OF THE INVENTION

Figure 1:
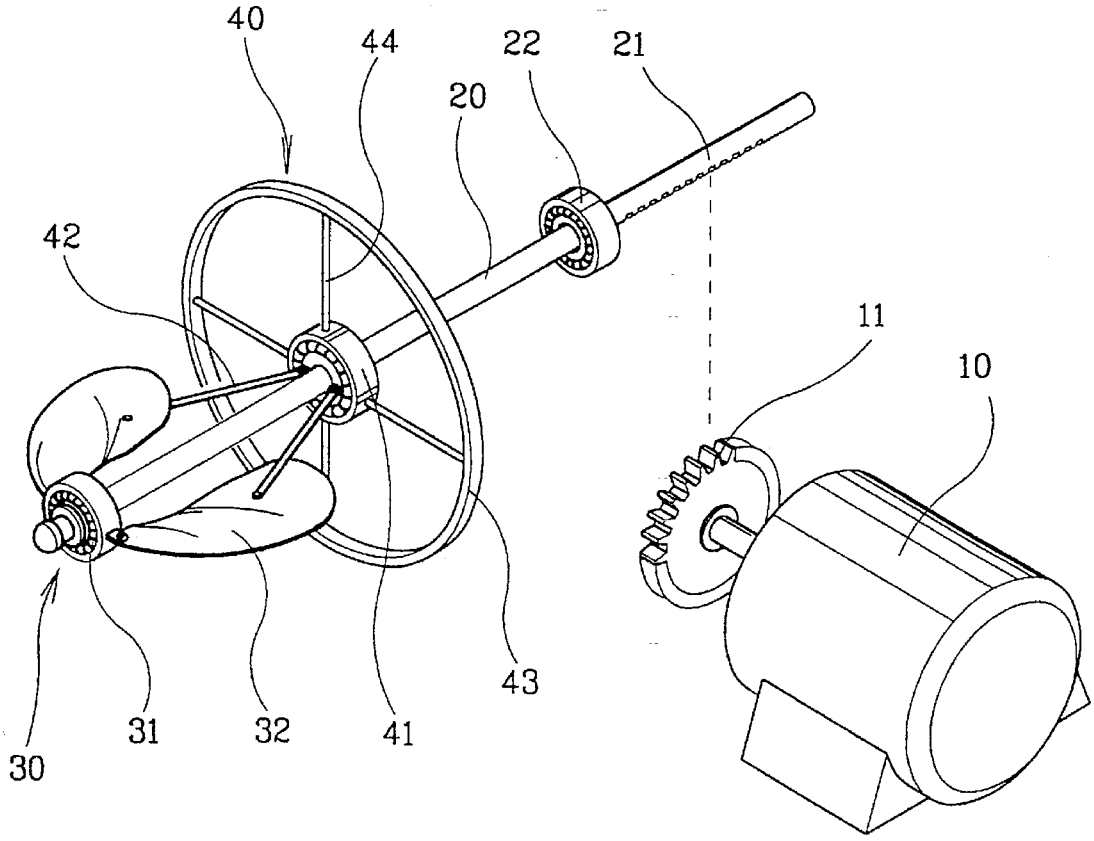
FIG. 1 is a depiction of the elements of the invention.

Reference will now be made in detail to the present preferred embodiments of the invention, examples of which are illustrated in the accompanying drawings. The invention comprises an operation unit including a step motor 10, shaft 20, turbulence generator 30 and anchor 40. Step motor 10 operates under the control an electronic control unit (ECU) 50.

Step motor 10 includes driving gear 11 fixed to the end of an operating shaft. ECU 50, in response to rotating rate of engine A or the speed of the vehicle above or below a certain predetermined value or standard, generates a signal causing step motor 10 to rotate driving gear 11 in one direction or the other.

Shaft 20 is an operating rod installed to slide in the direction of its axis in response to movement of step motor 10. One end of shaft 20 and most of the body of shaft 20 is disposed in intake manifold 70. Shaft 20 passes through the wall of intake manifold 70 extending to the other end outside the intake manifold. Shaft 20 is supported by first bearing 22 in the wall of intake manifold 70 to permit slidable movement of the shaft in its axial direction. The other end of shaft 20, extending outside the intake manifold, includes rack gear 21 that engages driving gear 11 fixed to step motor 10.

Turbulence generator 30 comprises second bearing 31 fixed at the one end of shaft 20 in the intake manifold 70. Multiple rotating fan blades 32 (in this embodiment two blades) are attached to the outer ring of second bearing 31 for pivotal movement between a folded position generally parallel to the axis of shaft 20 and an unfolded position generally perpendicular to the axis of shaft 20. The turbulence generator 30 slides with shaft 20 when the shaft moves axially.

Anchor 40 is disposed between turbulence generator 30 and first bearing 22. Anchor 40 comprises a third bearing 41 disposed for slidably supporting shaft 20, frame 43 attached to the inner wall of intake manifold 70 and multiple ribs connecting radially the outer ring of third bearing 41 and frame 43.

Preferably each fan blade 32 is connected to the inner ring of third bearing 41 by link 42. Each link 42 is hingedly connected at one end to a blade 32 and at the other end to the inner ring of third bearing 41. Link 42, therefore, folds and unfolds fan blades 32 when the shaft 20 moves in the direction of its axis.

Figure 2:
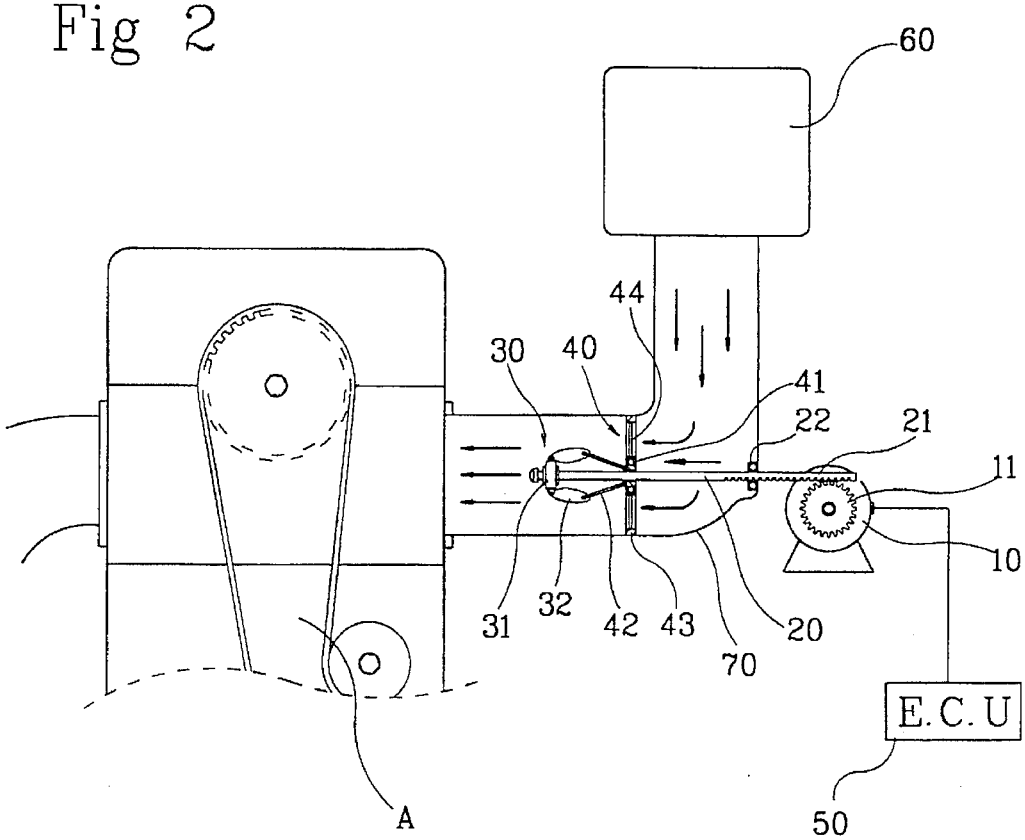
FIG. 2 depicts the invention disposed in an engine operating at high speed.

During high speed operation, as depicted in FIG. 2, when the RPM gauge, or speed meter (not depicted) detects the rotation rate of the engine A, or the speed of the vehicle, is above a certain standard or predetermined level, ECU 50 actuates step motor 10 for a predetermined period of time to push shaft 20 toward the intake port (to the left side as depicted in FIG. 2). Such movement of shaft 20 moves second bearing 31 at the one end of shaft 20 causing fan blades 32 to fold backward by means of links 42 connecting fan blades 32 and the inner ring of third bearing 41 on anchor 40. With the fan blades 32 folded, air flow induced through air cleaner 60 by strong inhalation force of the cylinders during high speed operation, is introduced into the cylinder rapidly, without large resistance.

Figure 3:
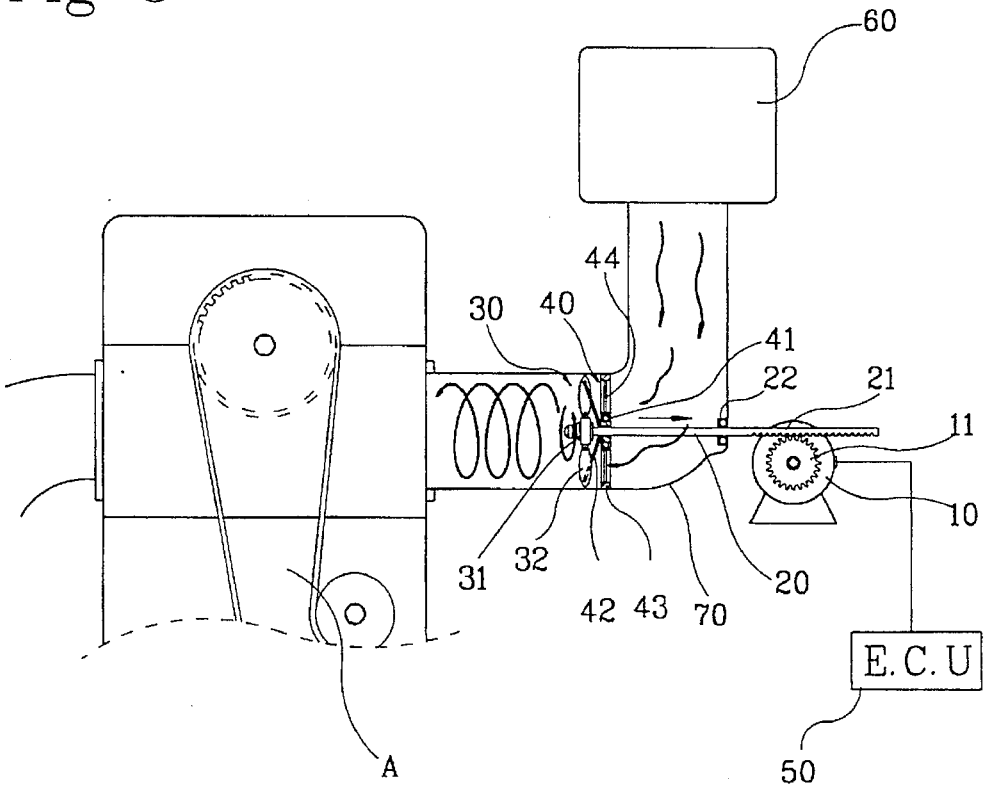
FIG. 3 depicts the invention disposed in an engine operating at low speed.

When the rotation of Engine A or the speed of the vehicle is detected to be below a predetermined level or a certain standard, turbulence generator 30 assumes the position depicted in FIG. 3. This is accomplished by ECU 50 causing step motor 11 to operate in the reverse direction from that of FIG. 2. Shaft 20 and second bearing 31 moved backward together (to the right side is depicted in FIG. 3), and turbulence generator 30 approaches anchor 40. Links 42 connected to fan blades 32 rotate clockwise about hinges at their contact points on the inner ring of fixed third bearing 41 thereby unfolding fan blades 32 to positions radially extending from shaft 20.

When unfolded, like the opening of an umbrella, fan blades 32 are disposed in the air flow path and the fan blades begin to rotate due to the kinetic energy of the air flow through air cleaner 60. Air flow passing through rotating fan blades 32 is transformed into a spiral turbulence that is introduced into the intake port.

If the engine or vehicle then increases speed as described above, ECU 50 will cause shaft 20 to move again so as to fold fan blades 32.

Turbulence generator 30 increases combustion efficiency and output and decreases the unwanted exhaust gas by generating turbulence in the air flow at low speed to provide regular carburetion. This is accomplished by opening the fan blades into the air flow through axial movement of shaft 20, the fan blades then rotating as a result of the kinetic energy of the air flow.

On the other hand, at high speed operation, the rotating fan blades are folded to prevent their creating a resistance to air flow.

What is claimed is:

1. An apparatus for generating turbulence in the intake manifold of an engine in a motor vehicle, the apparatus comprising:

a reversable step motor having a drive shaft and a drive gear fixed thereto;

an elongated shaft being disposed for slidable movement along its axis and having one end disposed in the intake manifold and the other end extending outside the intake manifold, the other end of the shaft including a rack gear drivingly engaged by the drive gear;

an anchor fixed in the intake manifold and supporting the shaft for axial movement;

a plurality of fan blades mounted at the one end of the shaft for rotation about the shaft axis, each blade being pivotally mounted for movement between folded and unfolded positions in response to axial movement of the shaft; and a control unit for electrically operating the step motor in response to engine rotation rate or vehicle speed to cause the blades to unfold into the intake air stream when the rate or speed is below a predetermined value and to fold when the rate or speed is above a predetermined value.

2. The apparatus of claim 1 wherein the anchor includes a bearing structure slidably supporting the shaft and rotatable with respect to the shaft, each blade being connected to the bearing structure for pivotal movement between folded and unfoloded positions in response to axial movement of the shaft.

* * * * *